US005375859A

United States Patent [19]

Peck et al.

[11] Patent Number: 5,375,859

[45] Date of Patent: Dec. 27, 1994

[54] MECHANICAL BRAKE FOR IN-LINE ROLLER SKATE

[75] Inventors: David G. Peck; Stefan T. Cottle, both of Falls Church, Va.

[73] Assignee: David G. Peck, Falls Church, Va.

[21] Appl. No.: 111,935

[22] Filed: Aug. 26, 1993

[51] Int. Cl.[5] ..... A63C 17/14

[52] U.S. Cl. ..... 280/11.2; 280/11.22; 188/72.7

[58] Field of Search ..... 280/11.2, 11.22, 11.23, 280/87.042; 188/24.12, 24.22, 28, 56, 72.7

[56] References Cited

U.S. PATENT DOCUMENTS

| | | | |
|---|---|---|---|
| 177,565 | 5/1876 | Salladee | 280/11.2 |
| 296,833 | 4/1884 | Hanlon | 280/11.2 |
| 805,942 | 4/1905 | Beals | 280/11.2 |
| 1,026,712 | 5/1912 | Simon | 280/11.2 |
| 1,810,380 | 6/1931 | Van Etten | 280/11.2 |
| 2,191,018 | 2/1940 | Ickenroth | 280/11.2 |
| 2,193,685 | 3/1940 | Bruner | 280/11.2 |
| 2,826,422 | 3/1958 | Snyder | 280/11.2 |
| 2,941,812 | 6/1960 | Reynolds | 280/11.2 |
| 3,003,776 | 10/1961 | Ware | 280/11.2 |
| 3,112,119 | 11/1963 | Sweet | 280/11.2 |
| 3,112,120 | 11/1963 | Ware | 280/11.2 |
| 3,287,023 | 11/1963 | Ware | 280/11.2 |
| 3,734,244 | 5/1973 | Roddy | 280/11.2 |
| 3,823,952 | 7/1974 | Kukulowicz | 280/11.2 |
| 4,273,345 | 6/1981 | Ben-Dor et al. | 280/11.2 |
| 4,275,895 | 6/1981 | Edwards | 280/11.2 |
| 4,295,547 | 10/1981 | Dungan | 280/11.2 |
| 4,402,520 | 9/1983 | Ziegler | 280/11.2 |
| 5,028,058 | 7/1991 | Olson | 280/11.2 |
| 5,052,701 | 10/1991 | Olson | 280/11.2 |
| 5,088,748 | 2/1992 | Koselka et al. | 280/11.22 X |
| 5,226,673 | 7/1993 | Cech | 188/72.7 X |
| 5,280,930 | 1/1994 | Smathers et al. | 280/11.22 X |
| 5,308,093 | 5/1994 | Walin | 280/11.2 |

FOREIGN PATENT DOCUMENTS

| | | | |
|---|---|---|---|
| 029959 | 4/1979 | Australia | 280/11.2 |
| 368288 | 12/1923 | Germany | 280/11.2 |
| 3036799 | 5/1982 | Germany | 280/11.2 |
| 8200770 | 3/1982 | WIPO | 280/11.2 |

*Primary Examiner*—Brian L. Johnson

*Attorney, Agent, or Firm*—Hoffman, Wasson & Gitler

[57] ABSTRACT

A roller skate with in-line wheels employs a pair of brake discs capable of applying variable resistance to the rotation of the rear wheel. A skater may activate the brake by elevating the toe of the skate bringing a lever arm that is mounted at the rear of the skate and oriented downward into contact with the road surface. This contact causes the lever-arm to rotate as the toe is elevated. Rotation of the lever arm induces contact between the brake discs and the rotating rear wheel by forcing discs inward toward the wheel. Rotation of the lever arm and inward movement of brake discs is opposed by a separate spring device which returns the brake discs and the lever arm to a rest position when the skate is level, enabling the rear wheel to spin freely.

12 Claims, 4 Drawing Sheets

MECHANICAL BRAKE FOR IN-LINE ROLLER SKATE

BACKGROUND OF THE INVENTION

Prior patents for roller skate brakes may be divided into three categories. Several designs (U.S. Pat Nos. 2,193,685 4,273,345 5,028,058 5,052,701) induce friction between the skate and road surface by dragging an apendage, generally a rubber pad., along the road. This technique has been applied to both traditional broad-wheel type roller skates and to the in-line type and has achieved the greatest commercial success. It suffers, however, from a number of deficiencies: it creates insufficient friction to stop a skater moving at high speed in a short distance; it provides inadequate control due to variabale road surfaces and diminished contact between the wheels and road as the wheels are relieved of weight born by the brake surface; and the brake surface suffers from wear requiring frequent replacement or adjustment or resulting in deteriorating performance of the brake. Devices of this type, in other words, suffer from problems in effectiveness, control, and reliability.

A second category employs a brake that applies frictional resistance to the free rotation of one or more wheels but can not be applied or adjusted as the skate is in use. Designs of this type are intended for use in physical training of instruction by enabling the skater to increase the resistance to forward motion, thus building leg strength, or to limit the speed attainable, making the skate safer for beginners. This concept has been applied to the traditional broad wheeled type roller skate (U.S. Pat. No. 3,734,244) and to the in-line type skate (U.S. Pat. No. 3,823,952).

A third category of skate brake produces variable and spontaneously applied resistance to the free rotation of one or more wheels. All of these patents apply to traditional broad wheel type skates and all except one apply friction directly to the surface of the wheel that makes contact with the road. This approach has at least two difficulties: wear on the wheel surface is increased several fold because the brake increases the friction which the surface must endure, accelerating wear, particularly since the rolling surface of skate wheels are made of relatively soft materials (in comparison to brake surfaces) such as rubber or plastic to improve contact with the road surface; and all parts are exposed to dirt and moisture, limiting the effectiveness of the brake system. A number of these designs (U.S. Pat. Nos. 177,565 296,833 4,275,895 1,810,380 4,402,520) use lever arms that are deployed from the rear of the skate and are activated by elevating the toe of the skate. One design (U.S. Pat. No. 4,275,895) is activated by means of a lever deployed upwards from the rear of the skate and is activated by contact with, and deflection by, the calf of the skater's leg. A design that does not apply friction to the rolling surface of the skate wheel applies resistance instead between the rear axle and the rear wheel. This design (U.S. Pat. No. 4,402,520) is applicable to the traditional broad wheel type skate only and suffers from a number of deficiencies: a limited braking surface that provides insufficient friction to arrest a skater at high speed in a short distance; a tendency to lock, resulting in uncontrolled and dangerous stops, and susceptability to high rates of wear.

SUMMARY OF THE INVENTION

The design described herein provides effective, precisely attenuated arresting force for a skater using in-line type roller skates enabling a skater to affect quick and controllable stops, and to reduce or control speeds on steep grades. The present invention provides braking action directly to the rear wheel of an in-line roller skate by pivoting the skate about its rear wheel, thus deploying a lever arm against a road surface which forces a brake plate, sliding along the wheel axle, to contact a friction surface on the wheel. This mechanism provides reliable brake modulation and allows large braking forces to be generated when needed, bringing the skater to a stop with greater confidence and over a shorter distance than prior art brake systems.

The lever arm is positioned with one end rotatable about the axle of the rear wheel and the other end extending rearward of the axle suspended above the road surface. A brake plate is positioned on the axle between the lever arm and the wheel, and is kept a distance from the wheel by a spring located between the brake plate and the wheel. The brake plate has one or more ramping elements on a surface facing outward to the lever arm. The ramps are positioned so that when the lever arm is rotated upward, contact is made with them. Where the brake plate is placed on the axle, the axle has a non-circular cross-section, permitting the brake plate to slide axially but preventing it from rotating.

During skating, when braking is not desired, the brake plate is separated from the wheel, and the wheel is free to rotate. When braking is required, the skate is pivoted about its rear axle, causing the lever arm to rotate upward. The lever arm engages the ramp surfaces on the brake plate forcing the plate toward the wheel against the pressure of the springs. When the brake plate contacts the wheel, the friction causes the wheel to slow its rotation and the skater to slow down. When braking is no longer required, the skate is rotated forward, the lever arm drops to its normal position, and the brake plates are removed from contact with the wheel by the force of the springs.

BRIEF DESCRIPTION OF THE DRAWINGS

The above features will be described with reference to the accompanying drawings in which.

DETAILED DESCRIPTION OF THE PREFERRED EMBODIMENT

Figure 1:
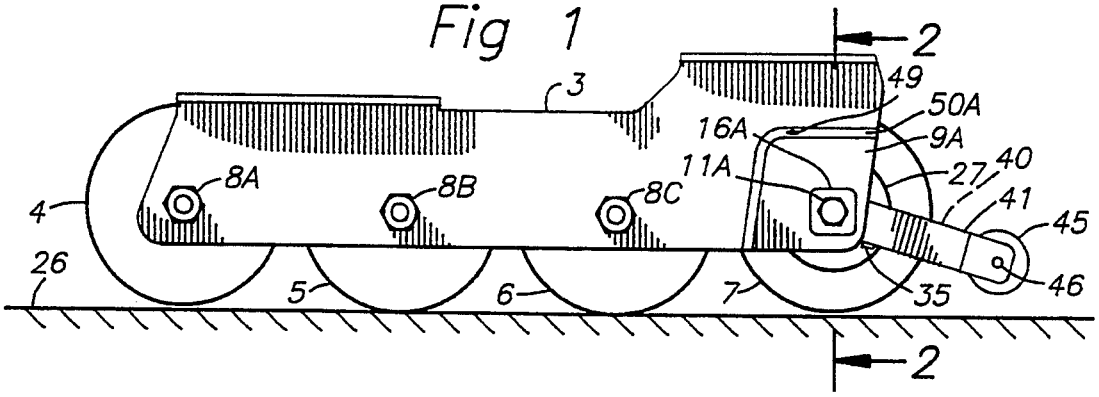
FIG. 1 is a side view of an in-line skate frame embodying the invention showing brake in the normal skating position.
Figure 7:
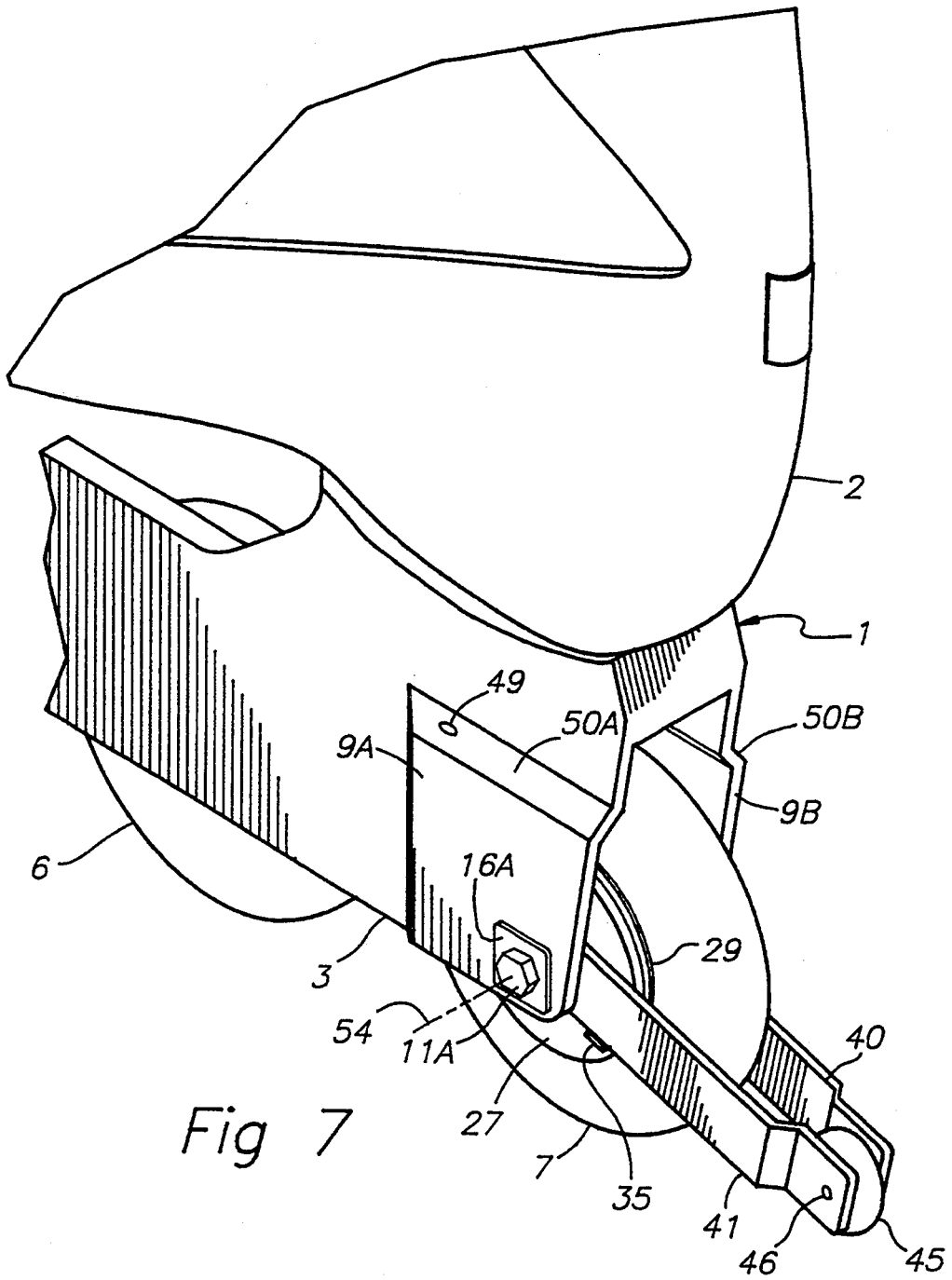
FIG. 7 is a side perspective view of an in-fine roller skate embodying the invention.

Referring now to the drawings, there is shown in FIG. 7 an in-line roller skate 1 which includes a boot 2 for wear by skater, a skate frame 3 which supports a plurality of wheels, here shown in FIG. 1 as wheels 4, 5, 6, and 7.

Referring to FIG. 1, wheels 4, 5, and 6 are rotably mounted to the frame 3 by means of nut and bolt combinations 8A, 8B, and 8C. The frame 3 is shown here carrying four wheels, but it should be understood that the mounting of five or more wheels to the frame is with the the purview of the invention.

Figure 8:
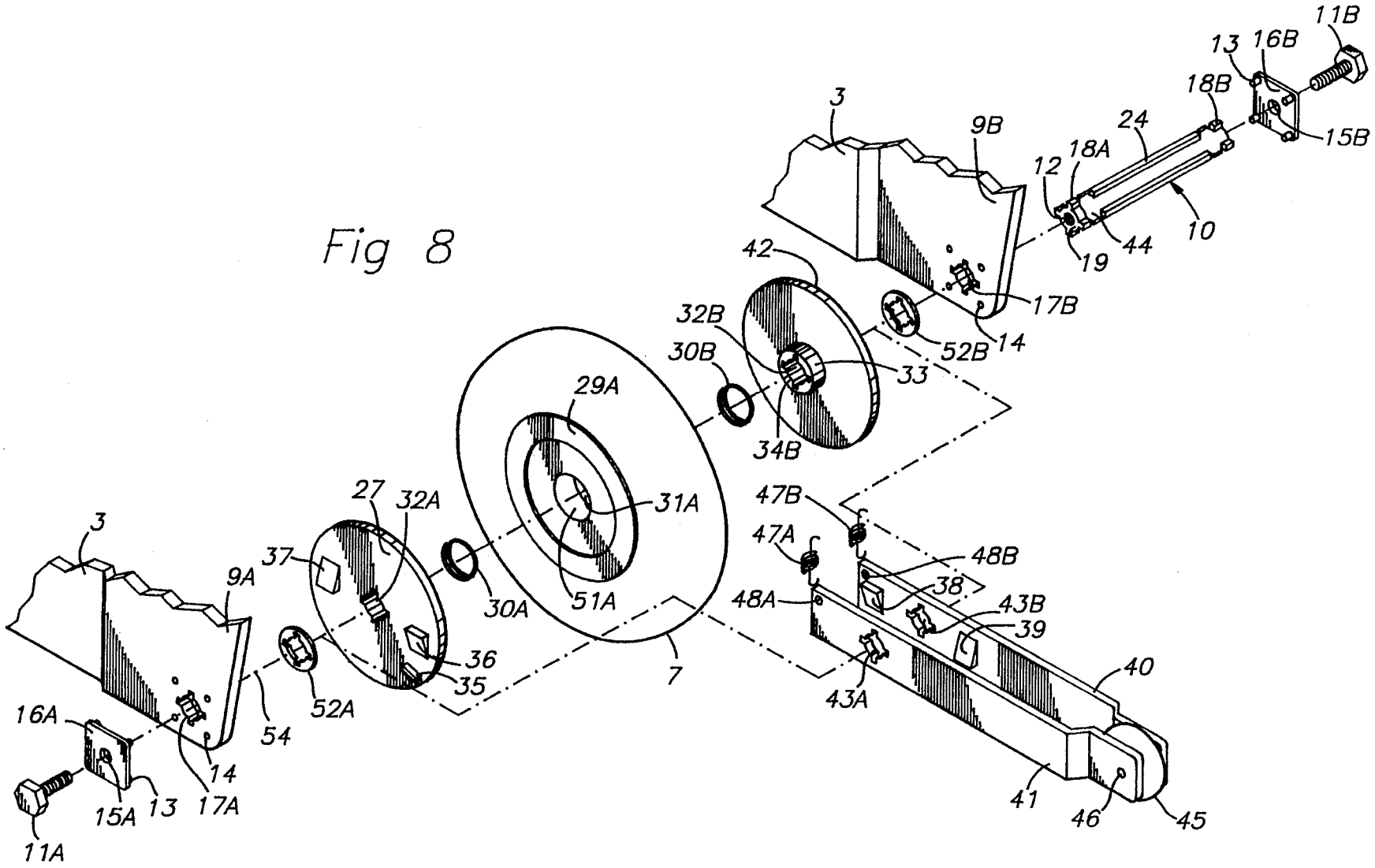
FIG. 8 is an exploded perspective view of the components of the skate brake assembly.

Referring to FIG. 1 and FIG. 8, the rearmost wheel 7 is mounted to the rear of the skate frame 3, where the frame has widened portions 9A and 9B to accomodate the rear wheel braking assembly, by means of a central axle 10. The central axle 10 is fastened to the rear portion of the frames 9A and 9B by seating the keyed ends 18A and 18B of the axle inside the matching keyed cutouts 17A and 17B, ensuring the axle end faces 19 are flush with the outer surfaces of the skate frame 9A and 9B. Two support plates 16A, 16B are mounted to the outer surface on both sides of the skate frame 9A and 9B by fitting a set of protrusions 13 (FIG. 8), which are integral to support plates 16, into receiving cutouts 14 in the skate frame 9A and 9B. Two bolts 11A, 11B pass through circular cutout 15A, 15B in the support plates 16 and thread into threaded portions 12 located along the central axis on both ends of the axle 10.

Figure 2:
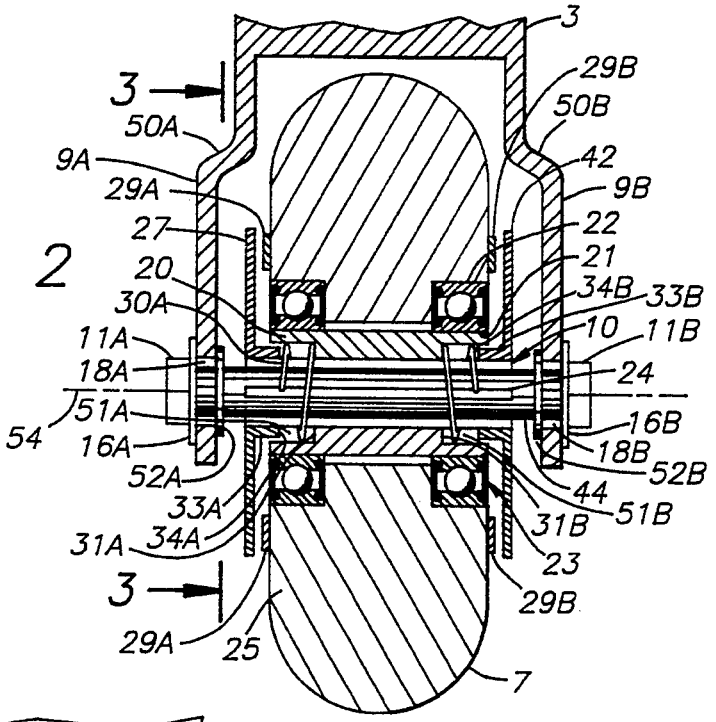
FIG. 2 is a partial cross sectional rear view of rear wheel and brake mechanism in normal skating position, taken in the direction of cutting plane 2—2 of FIG. 1.

Referring now to FIG. 2, the rearmost wheel 7 is mounted to the central axle 10 whereby a wheel hub 20 is rigidly attached to the keyed or non-circular central portion 24 of the central axle 10. Two bearings 23 mounted about the wheel hub 20 on both sides of wheel 7 provide easy rotation of the wheel. The inner races 21 of the bearings 23 are fixed to the wheel hub 20, while the outer races 22 are fixed to the wheel material 25 that contacts the rolling surface 26. This allows wheel 7 to rotate freely relative to the central axle 10. It should be noted that although one specific type of ball bearing is illustrated, any usable beating type is within the purview of the invention.

Two disc-type brakes 27 and 42 are mounted to the keyed central portion 24 of the central axle 10. These disc brakes are shown having a generally rectangular cross-section. However, a conical or other shaped cross-section is within the purview of the invention. The brake discs have matching keyed cutouts 32A and 32B that is designed to be slightly larger than the axle key 24, allowing free axial motion along the axle's central axis. The brake discs have a diameter which is greater that that of the bearings 23 and extends slightly beyond the diameter of brake pads 29A and 29B integral to, and located on the outer surfaces of both sides of, the wheel 7. Brake pads 29A and 29B are annular rings concentric with the central axis of the wheel, and are made of a material which has a high friction coefficient and resists heavy wear. The surfaces of the brake discs facing the skate frames 9A and 9B feature a small, integral, protruding shelf 35 on which the bottom surfaces of lever arms 40 and 41 rest during normal skating. Two opposing ramp surfaces 36 and 37, also integral to the brake discs 27 and 42 come in contact with mating ramp surfaces 38 and 39 integral to the lever arms 40 and 41 during brake engagement.

Protruding cylindrical features 33A and 33B integral to the inner surface of brake discs 27 and 42 fit into cylindrical cavities 51A and 51B formed in both sides of the wheel hub 20. It should be noted that the cavity may have a conical or other shape, accomodating the possible shapes of the brake discs. A means for applying force such as compression springs 30A and 30B provides a force beating on the protruding cylinder faces 34A and 34B and the cavity faces 31A and 31B preventing the brake disc surface and the brake pad surfaces 29A and 29B from contacting each other during normal skating. Other methods for applying the force necessary to prevent contact between the brake disc surface and the brake pad surface could comprise hydraulic or magnetic means, as desired.

Referring now to FIG. 8, the lever arms 40 and 41 each have cutouts 43A and 43B that match the keyed portion 24 of the central axle 10. The keyed portion of the cutouts 43A and 43B are provided for assembly purposes, so the central axle 10 may slide through them and fasten into place. The functional purpose of the cutouts 43A and 43B is to allow free rotation of the lever arms 40 and 41 about the unkeyed, circular portion 44 of the central axle 10. Circular washers 52A and 52B provide a wear-resistant surface against which lever arms 40 and 41 will bear, due to the outward force of the brake discs 27 and 42 generated by the springs 30A and 30B. Two ramp surfaces 38 and 39, integral to the lever arms, are located equidistant about the axis of the cutouts 43. These ramps contact mating ramps 36 and 37 on the brake discs during brake engagement. A small wheel 45 at the rearward extending end of the lever arms 40 and 41 rotates about an axle 46 and provides a low friction bearing surface during braking, when the rear of the lever arm is thrust onto the rolling surface 26. One end of each spring 47A and 47B is hooked into holes 48A and 48B located towards the end of each lever arm 40 and 41, the other end hooks into a hole 49 located in the angled transitions 50A and 50B of the skate frame.

Figure 3:
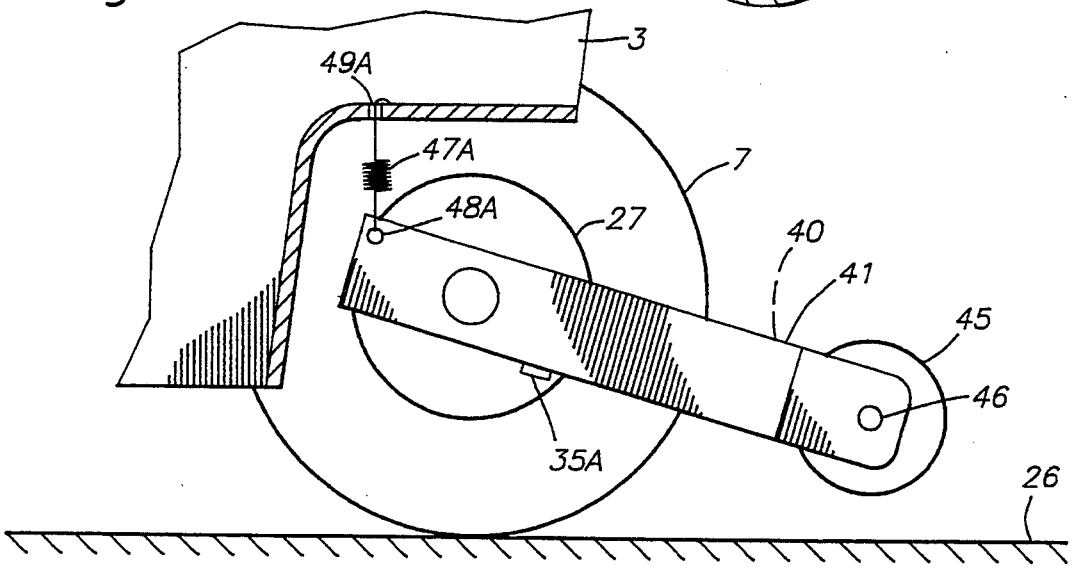
FIG. 3 is a side cross sectional view of FIG. 2, showing lever arm in normal skating position, taken in the direction of cutting plane 3—3 of FIG. 2

As best seen in FIG. 3, the springs 47A and 47B provide a force which tends to rotate lever arms 40 and 41 in a clockwise fashion, causing the bottom surfaces of lever arms 40 and 41 to rest on the protruding shelves 35, and further preventing ramp surfaces 38 and 39 on the lever arms 40 and 41 from contacting mating ramps 36 and 37 during normal skating.

Figure 4:
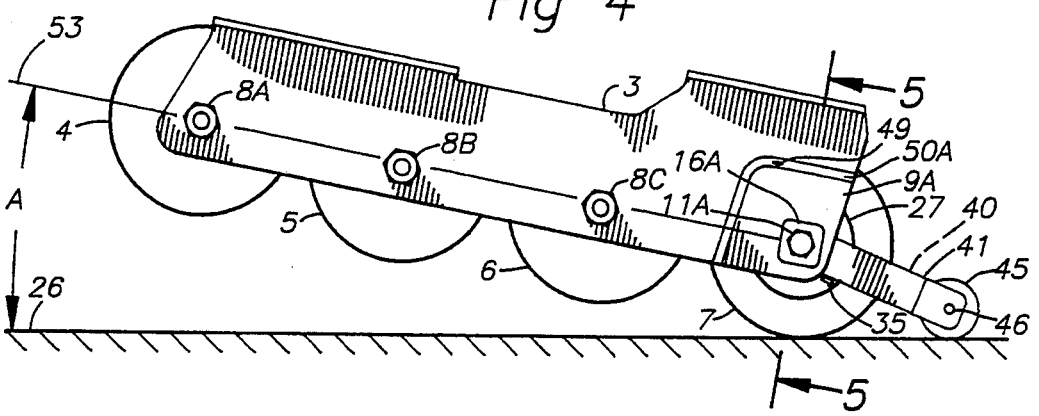
FIG. 4 is a side view of an in-line skate frame embodying the invention, similar to FIG. 1, only showing skate and lever arm in the braking position and the brake mechanism engaged.
Figure 5:
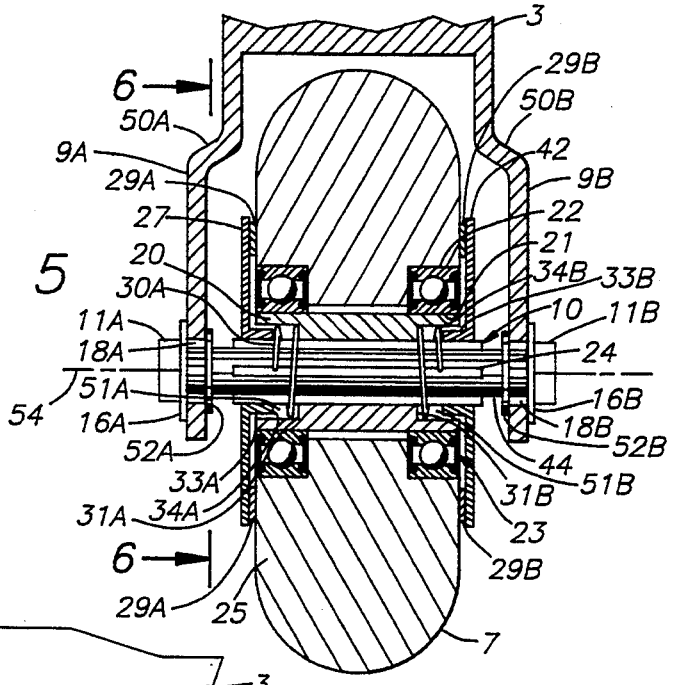
FIG. 5 is a partial cross sectional rear view of FIG. 4, showing skate and lever arm in the braking position and the brake mechanism engaged, taken in the direction of cutting plane 5—5 of FIG. 4.
Figure 6:
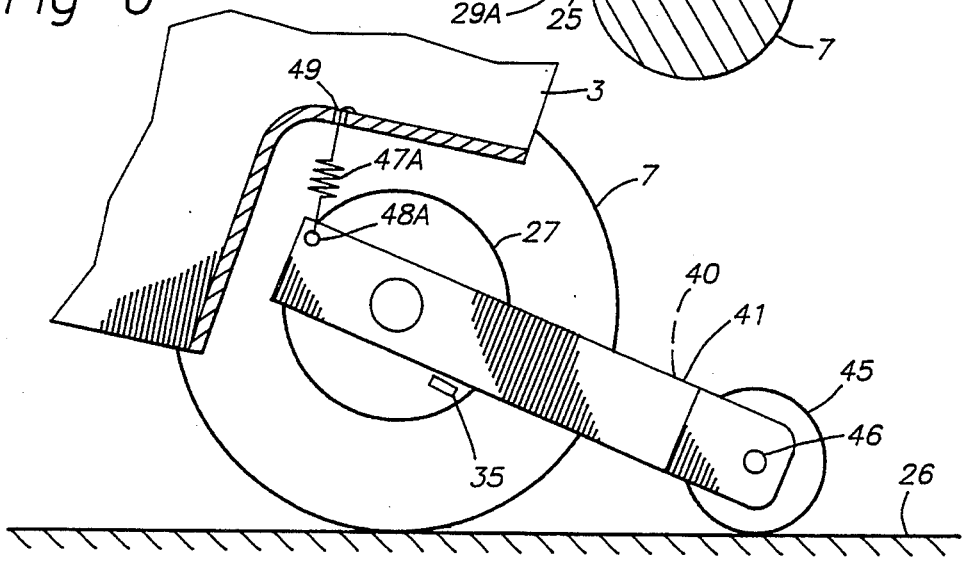
FIG. 6 is a side cross sectional view of FIG. 5, showing skate and lever arm in the braking position and the brake mechanism engaged, taken in the direction of cutting plane 6—6 of FIG. 5.

In the operation of the skate brake of the aforementioned embodiment of the invention, when the skater wishes to brake, he raises the front end of one or both skates 1 causing the skate to pivot around the rear wheel axis 54 (FIG.4 through FIG. 6). The skate rotates through arc A urging the rear lever arms 40 and 41, and the small wheel 45 attached thereto, towards the rolling surface 26. The size of are A is approximately 12 degrees, and is formed by plane 53 alligned with wheels 4 and 7 and the rolling surface 26. Keeping are A within approximately 12 degrees provides the skater with safe and controlled braking, requiting little practice to feel comfortable in a braking maneuver.

As the rear lever arms 40 and 41 contact the rolling surface 26, they rotate counterclockwise (as depicted in FIG. 4 and FIG. 6), relative to the skate frame 3, about the rear wheel axis 54. This relative rotation of the rear lever arms 40 and 41 causes ramp surfaces 38 and 39 on the rear lever arms 40 and 41 to contact ramp surfaces 36 and 37 on the brake discs 27 and 42. The contact between ramp surfaces 38 and 39 on the rear lever arms 40 and 41 and ramp surfaces 36 and 37 on the brake discs 27 and 42 cause the brake discs 27 and 41 to slide toward the rear wheel 7 and the brake pad surface 29 along the rear wheel central axle 10 (FIG. 5). The opposing force of the brake discs being urged toward the broke pad surface 29 causes lever arms 40 and 41 to bear against washer 52, which prevents lever arms 40 and 41 from contacting the rear portion of the skate frame 9.

As the rear lever arms 40 and 41 are rotated counter-clockwise relative to the skate frame 3 (as depicted in FIG. 4 and FIG. 6), the contact between mating ramp surfaces 38 and 39 and 36 and 37 causes the brake discs 27 and 42 to create a counter-clockwise moment about the rear wheel axis 54. Since the brake discs 27 and 42 are fixed in rotation about the rear wheel central axle 10, the rear wheel central axle will transfer this moment to the keyed cutouts 17A and 17B and the support plate 16. The keyed cutouts 17A and 17B will absorb some of the moment, and the support plate 16 will absorb the remaining moment by transferring it to the protrusions which mate to receiving cutouts 14 in the rear portion of the skate frame 9.

As the brake discs 27 and 42 contact the brake pad surfaces 29A and 29B, the high coefficient of friction between the brake discs 27 and 42 and the brake pad surfaces 29A and 29B causes rotation of the rear wheel 7 to slow or stop, slowing or stopping the skater. Since the amount of braking force imparted to the rear wheel 7 is related to the friction force between the brake pad surface 29 and the brake discs 27 and 42, varying the force of the brake discs 27 and 42 on the brake pad surfaces 29A and 29B will affect the braking rate. The motion of brake discs 27 and 42 is directly related to the rotation of the rear lever arms 40 and 41. It is therefore possible to vary the braking rate by slimily varying the arc A and, as a result, the contact force of the rear lever arms 40 and 41 and the small wheel 45 on the rolling surface 26. A skater can precisely control his rate of braking by modulating the are A and the force of the rear lever arms 40 and 41 and the small wheel on the rolling surface 26.

The operation of the skate brake has an antilocking function which prevents the rear wheel from locking and skidding on the rolling surface 26, when the rolling surface 26 has adequate friction between it and the rear wheel. If the friction force between the brake discs 27 and 42 and the brake pad surfaces 29A and 29B passes a threshhold, causing locking, the rear wheel 7 will stop rolling on the rolling surface 26 and will skid. The high frictional forces transferred from the interface between the rear wheel 7 and the rolling surface 26 will tend to rotate the front of the skate 1 downward about the rear wheel axis 54, reducing arc A and reducing the force of the rear lever arms 40 and 41 on the rolling surface 26. This causes the brake discs 27 and 42 to slide outward on the rear wheel central axle 10 reducing the friction force between the brake discs 27 and 42 and the brake pad surfaces 29A and 29B, eliminating the locked condition. The antilocking function will tend to articulate the skate 1 clockwise and counter-clockwise about the rear axis 54 as the force of the skater urging the skate 1 rearward is counteracted by the friction force between the rear wheel 7 and the rolling surface 26 urging the skate forward.

When the skater has completed the braking action, the skate is rotated so the plane of the wheels 53 is parallel to the rolling surface 26 (FIG.1). The force of the springs 47A and 47B induces the lever arms to rotate clockwise and the ramp surface 36 and 37 and 38 and 39 to separate (FIG.2). This causes the brake discs 27 and 42 to slide outward and separate from the brake pad surfaces 29A and 29B and the rear wheel is allowed to rotate freely.

While the preferred embodiments of the present invention have been described, it should be understood that various changes, adaptations and modifications may be made therein without departing from the spirit of the invention and the scope of the appended claims.

What is claimed is:

1. A braking device for an in-line roller skate, having at least one wheel, comprising:

a lever arm having a first end rotatable about a central axis of said wheel and a second end of said lever arm providing contact with a road surface;

an axle positioned on said central axis of said wheel rigidly fastened to a frame on said roller skate so as to prevent rotation of said axle relative to said frame;

a plurality of brake plates each positioned on said axle between said first end of said lever arm and said wheel positioned on said central axis; engaging means between said brake plates and said lever arm to allow contact of at least one of said brake plates and said wheel to provide braking; and a means for applying force positioned between said wheel and said brake plates providing outward pressure between said wheel and said brake plates so as to prevent contact of said brake plates with said wheel when free rotation of said wheel is desired.

2. The device of claim 1 wherein said axle has a circular cross-section where said first end of said lever arm is attached to said axle allowing free rotation of said lever arm about said axle, and said axle having a non-circular cross-section where said brake plates are attached to said axle allowing axial movement of said brake plates while preventing rotation of said brake plates about said axle.

3. The device of claim 1 Wherein said wheel has a broke bearing surface facing said brake plates so as to provide sufficient friction between said brake plates and said brake bearing surface slowing or bringing a skater to a stop, as a result of the braking action, and to prevent excessive wear on said wheel after repeated braking actions.

4. The device of claim 1 wherein each of said brake plates and said lever arm further comprise a means for converting rotation of said lever arm into axial movement of said brake plates.

5. The device of claim 1 in accordance with claim 4 wherein said means for converting rotation comprises raised ramp surfaces for inducing axial movement of said brake plates along said axle.

6. The device of claim 1 wherein said means for applying force to provide outward pressure between said wheel and said brake plates comprises a spring means.

7. The device of claim 1 wherein said lever arm is a forked configuration wherein forked ends rotate about said axle.

8. The device of claim 1 wherein said lever arm further comprises a small wheel connected at second end of said lever arm making contact with the road surface.

9. A braking device for an in-line roller skate, having at least one wheel, comprising:

a lever arm having a first end rotatable about a central axis of said wheel and a second end of said lever arm providing contact with a road surface;

an axle positioned on said central axis of said wheel rigidly fastened to a frame on said roller skate so as to prevent rotation of said axle relative to said frame;

a plurality of brake plates each positioned on said axle between said first end of said lever arm and said wheel positioned on said central axis;

a means for applying force positioned between said wheel and said brake plates providing outward pressure between said wheel and said brake plates so as to prevent contact of said brake plates with said wheel when free rotation of said wheel is desired;

said axle have a non-circular cross-section where said brake plates are attached to said axle allowing axial movement of said brake plates while preventing rotation of said brake plates about said axle; and said brake plates and said lever arm further including a means for converting rotation of said lever arm into axial movement of said brake plates.

10. The device of claim 9 wherein said wheel has a brake bearing surface facing said brake plates so as to provide sufficient friction between said brake plates and said brake bearing surface slowing or bringing a skater to a stop, as a result of the braking action, and to minimize wear on said wheel after repeated braking actions.

11. A braking device for an in-line roller skate having at least one wheel, an axle positioned on a central axis of said wheel rigidly fastened to a frame on said loller skate so as to prevent rotation of said axle relative to said frame, a forked lever arm with forked ends rotatable about said axle, and the second end of said lever arm contacting a road surface, comprising:

a brake plate positioned on said axle on each side of said wheel between said wheel and forks of said forked end of lever arm;

a spring like means for applying force between said wheel and said brake plates providing outward pressure between said wheel and said brake plates so as to prevent contact of said brake plates with said wheel when free rotation of said wheel is desired;

said axle having a circular cross-section where said forked end of said lever arm is attached to said axle allowing free rotation of said lever arm about said axle;

said axle further having a non-circular cross-section where said brake plates are attached to said axle allowing axial movement of said brake plates while preventing rotation of said brake plates about said axle;

said wheel having a brake beating surface facing said brake plate so as to provide, sufficient friction between said brake plates and said brake beating surface slowing or bringing a skater to a stop, as a result of the braking action, and to prevent excessive wear on said wheel after repeated braking actions;

said brake plates and said forked lever arm further having raised ramp surfaces for converting rotation of said forked lever arm into axial movement of said brake plates; and said forked lever arm further including a small wheel connected at second end making contact with road surface.

12. The device of claim 11 where said braking device is located on the rearmost wheel of a multiwheeled in-line roller skate.

* * * * *